US005168786A

United States Patent [19]

Huggins et al.

[11] Patent Number: 5,168,786

[45] Date of Patent: Dec. 8, 1992

[54] CUTTING APPARATUS

[75] Inventors: Orville C. Huggins, Dayton; John D. Mistyurik, Troy; Larry D. Strausburg, Waynesville, all of Ohio

[73] Assignee: Monarch Marking Systems, Inc., Dayton, Ohio

[21] Appl. No.: 505,637

[22] Filed: Apr. 6, 1990

[51] Int. Cl.[5] ..... B26D 1/60

[52] U.S. Cl. ..... 83/308; 83/314; 83/316; 83/508; 83/578; 83/614

[58] Field of Search ..... 83/308, 314, 315-317, 83/318-320, 508, 578, 614, 38, 311, 582, 583; 384/451, 481, 482

[56] References Cited

U.S. PATENT DOCUMENTS

| | | | |
|---|---|---|---|
| 2,076,180 | 4/1937 | Griswold | 384/451 |
| 2,930,269 | 3/1960 | Kennedy | 83/318 X |
| 3,169,429 | 2/1965 | Bognar | 83/38 |
| 3,633,447 | 1/1972 | Casida | 83/508 X |
| 3,808,928 | 5/1974 | Plegat | 83/314 X |
| 3,823,635 | 7/1974 | Carlson | 83/508 X |
| 3,945,284 | 3/1976 | Wetzels et al. | 83/318 X |
| 4,355,794 | 10/1982 | Costigan | 83/583 X |
| 4,506,575 | 3/1985 | McCay et al. | 83/614 X |
| 4,515,053 | 5/1985 | DuBois | 83/508 X |
| 4,517,872 | 5/1985 | Dontschell | 83/508 X |
| 4,525,088 | 6/1985 | Shipos et al. | 83/508 X |
| 4,693,151 | 9/1987 | Goubeaux et al. | 83/23 |
| 4,776,714 | 10/1988 | Sugiura et al. | 400/248 |
| 4,921,362 | 5/1990 | Werner | 384/482 |

*Primary Examiner*—Frank T. Yost
*Assistant Examiner*—Eugenia A. Jones
*Attorney, Agent, or Firm*—Joseph J. Grass

[57] ABSTRACT

There is disclosed a cutting apparatus which is an improvement over co-owned U.S. Pat. No. 4,693,151 including a mechanism for accelerating the cutting mechanism prior to transverse severing of a traveling web; wherein an elongate knife and a cooperating rotatable knife are mounted on separate mounting members which are biased to urge the knives into cutting cooperation; wherein an electric motor is stationarily mounted and the cutting mechanism moves together with the traveling web, and the electric motor causes the rotatable knife to travel through a flexible drive connection; and wherein the rotatable knife is mounted for sliding movement on a slide mounted on a rod, with the slide having a bearing protected by and between a pair of spaced floating seals received on the rod.

22 Claims, 6 Drawing Sheets

CUTTING APPARATUS

BACKGROUND OF THE INVENTION

1. Field of the Invention

This invention relates to the field of cutting apparatus.

2. Brief Description of the Prior Art

The present invention constitutes improvements over U.S. Pat. No. 4,693,151 which is assigned to Monarch Marking Systems, Inc.

SUMMARY OF THE INVENTION

It is a feature of the invention to provide an improved cutting apparatus of the type having an elongate knife and a cooperating rotatable knife, wherein the knives are moved together with a longitudinally advancing web by engagement of the knives with the web. It is desirable to accelerate the knives in the longitudinal direction before the cutting of the web begins especially where the web to be severed is relatively wide, for example four or more inches. The reason is that the wider the web the greater the extent and weight of the cutting apparatus, and consequently the greater the inertia. Any acceleration of the knives and their mounting members is beneficial and most preferably the acceleration should bring the knives up to the speed of the traveling web. In accordance with a specific embodiment of the invention, there is a cam which accelerates the knives before cutting begins. Once cutting begins, the advance or travel of the knives in the longitudinal direction is solely due to the cutting engagement of the nip of the knives with the traveling web.

The rotatable knife can be urged into cutting cooperation with the elongate knife by a spring washer on the pivot which mounts the rotatable knife as in the prior art U.S. patent to DuBois U.S. Pat. No. 4,515,053. A wavy spring washer is generally too weak or too strong due to inconsistent spring rates to provide good contact between the side of the elongate knife and the side of the rotatable knife. Also, a small wavy washer having only two waves allows the rotatable knife to rock on its shaft. Therefore, in accordance with the invention, the elongate knife has been mounted on one moving member and the rotatable knife has been mounted on another mounting member, and the mounting members are urged together by a spring, and more specifically, the mounting members are pivotally mounted to each other and the mounting members are biased toward each other to assure good knife cutting cooperation.

It has also been found that the cutting apparatus of U.S. Pat. No. 4,693,151 is improved by mounting the electric motor stationarily and by advancing the rotatable knife transversely through a flexible drive connection. Specifically, the drive connection between the electric motor and the rotatable knife is through a pair of toothed wheels with which a toothed belt cooperates. The toothed wheels are mounted on generally parallel shafts. One of the toothed wheels is mounted on the shaft of the stationary electric motor. The other toothed wheel moves as a unit together with the knives in the direction of longitudinal movement of the traveling web. In that the amount of movement of the other toothed wheel is not great and because of stretch in the belt, an effective flexible drive connection is maintained.

It is another feature of the invention to provide an apparatus of the type described with improved structure to varying the length of travel of the rotatable knife. In a specific embodiment of the invention, the rotatable knife is mounted on a slide or carriage. By positioning a switch at a selected position along the length of travel of the slide, a magnet on the slide will operate the switch in accordance with the width of the web.

It is another feature of the invention to provide a knife-carrying slide mounted on a rod by at least one and preferably two bearings. A pair of seals straddle the bearing(s). The seals prevent paper dust and other debris from contacting the bearing(s). The seals float on the body of the slide so that even though the slide cants slightly during both acceleration prior to severing and during severing of the web, the integrity of the seal is maintained. The bearing(s) are preferably of the recirculating-ball type.

DETAILED DESCRIPTION OF THE PREFERRED EMBODIMENT

Figure 1:
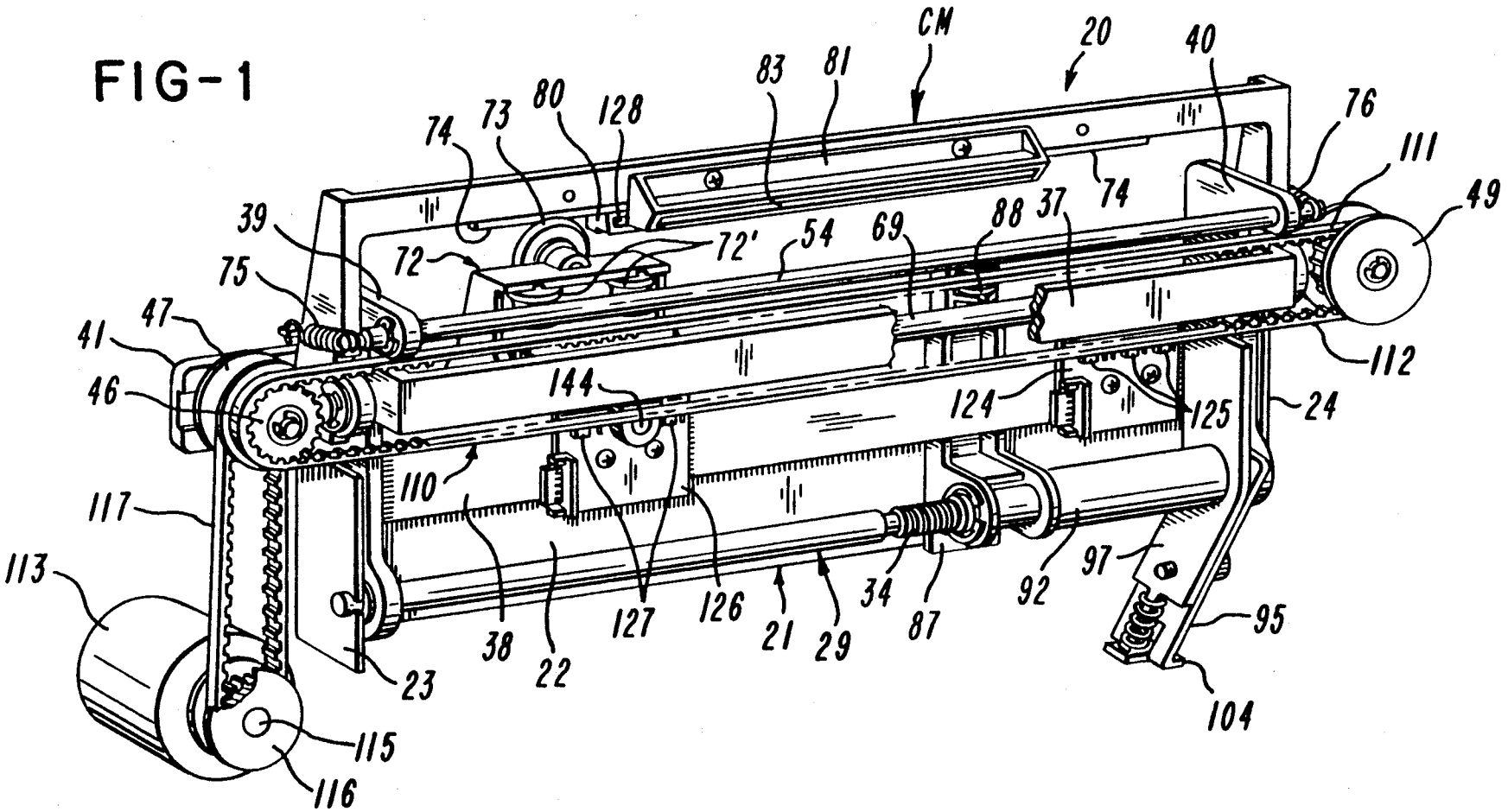
FIG. 1 is a perspective view of a cutting apparatus in accordance with the invention.
Figure 2:
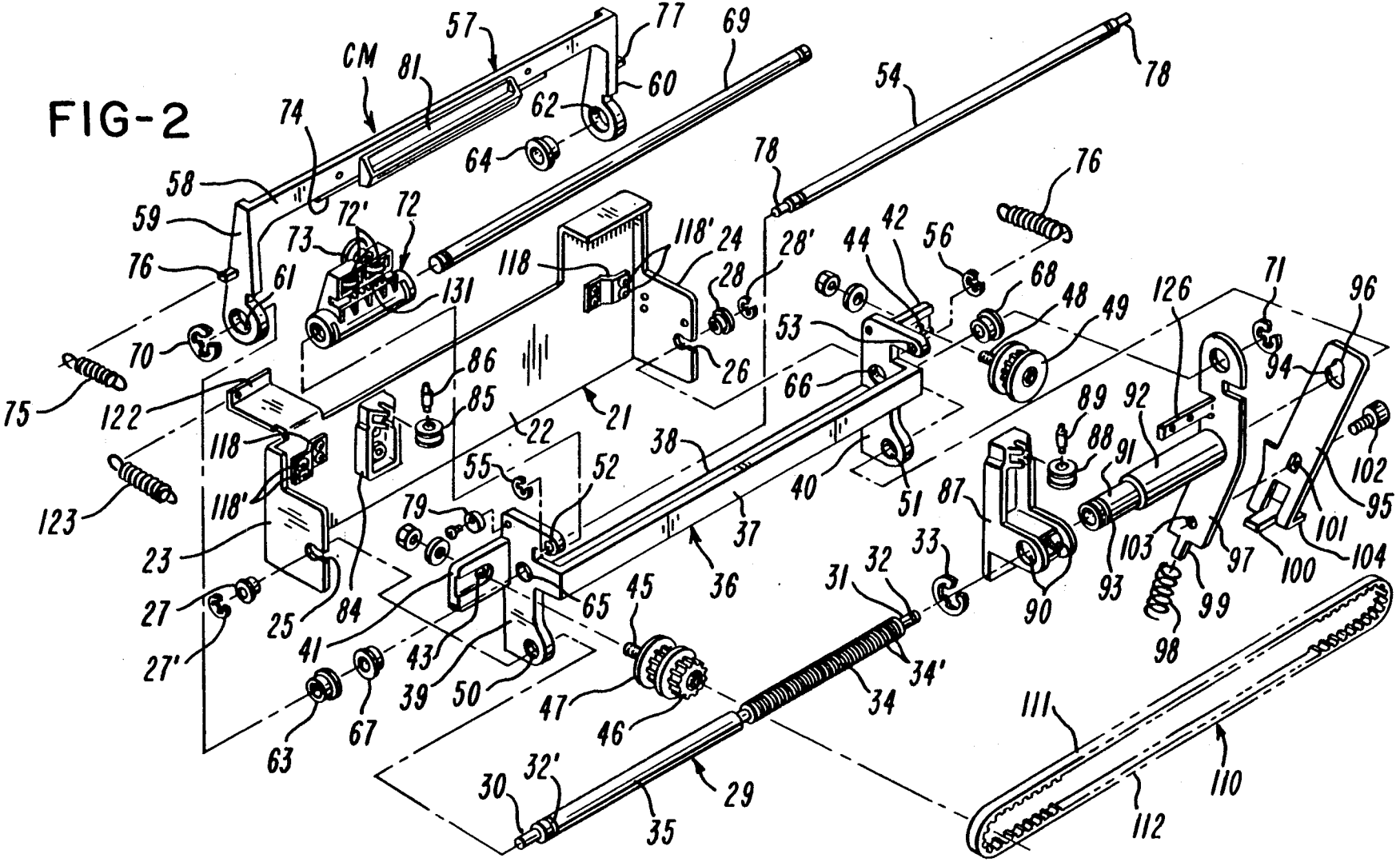
FIG. 2 is an exploded perspective view of certain of the components of the cutting apparatus shown in FIG. 1.

Referring initially to FIGS. 1 and 2 of the drawings, there is shown a cutting apparatus generally indicated at 20 including a movable cutting mechanism CM. The apparatus includes a frame generally indicated at 21 having a planar portion 22 and a pair of wall or tab portions 23 and 24. While the frame 21 is formed of a bent steel plate, it can be a casting as well. The wall portions 23 and 24 have cutouts 25 and 26 which receive respective plastics bushings 27 and 28. A rod generally indicated at 29 has a reduced end portion 30 received in the bushing 27 and reduced end portion 31 received in the bushing 28. A groove 32 on the end portion 31 receives an E-ring 28'. The rod 29 also has a threaded portion 34 and an unthreaded annular portion 35. A groove 32' adjacent end portion 30 receives an E-ring 27'.

A mounting member generally indicated at 36 has spaced parallel bars 37 and 38 and a pair of end members 39 and 40 joined to the bars 37 and 38. A pair of tabs 41 and 42 coplanar with the bar 38 have respective holes 43 and 44. A shaft 45 received in the hole 43 rotatably mounts a pair of toothed wheels 46 and 47. The toothed wheels 46 and 47 are screwed together so that they rotate as a unit. A shaft 48, generally parallel to the shaft 45, received in the hole 44 rotatably mounts a toothed wheel 49.

The end member 39 has a hole 50 which receives the annular portion 35 adjacent the reduced end portion 30. The end member 40 has a hole 51 which receives the reduced end portion 31 between the E-ring 33 in the groove 32 and the threaded portion 34. The end members 39 and 40 have respective holes 52 and 53 which receive a rod 54. The rod 54 is retained in place by E-rings 55 and 56.

Figure 6:
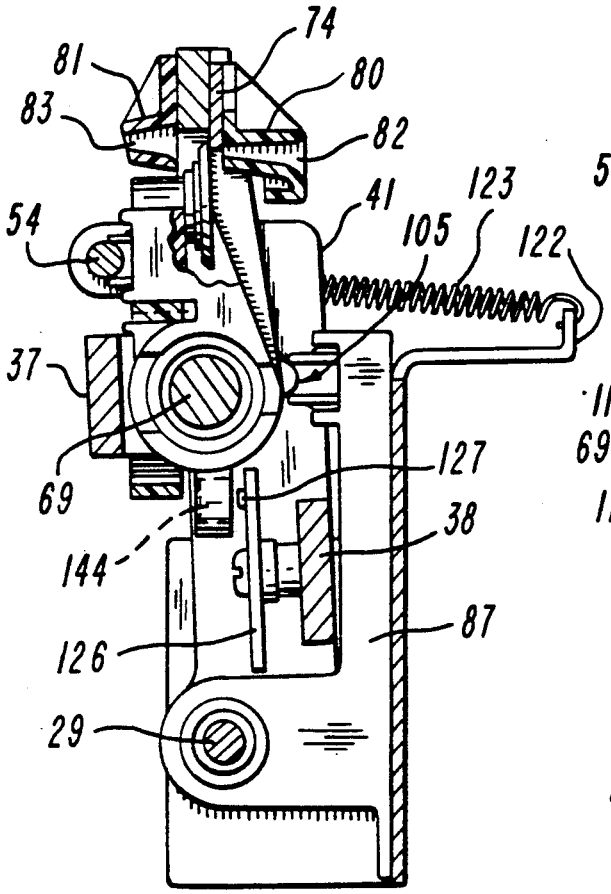
FIG. 6 is a vertical sectional view of a portion of the apparatus.
Figure 11:
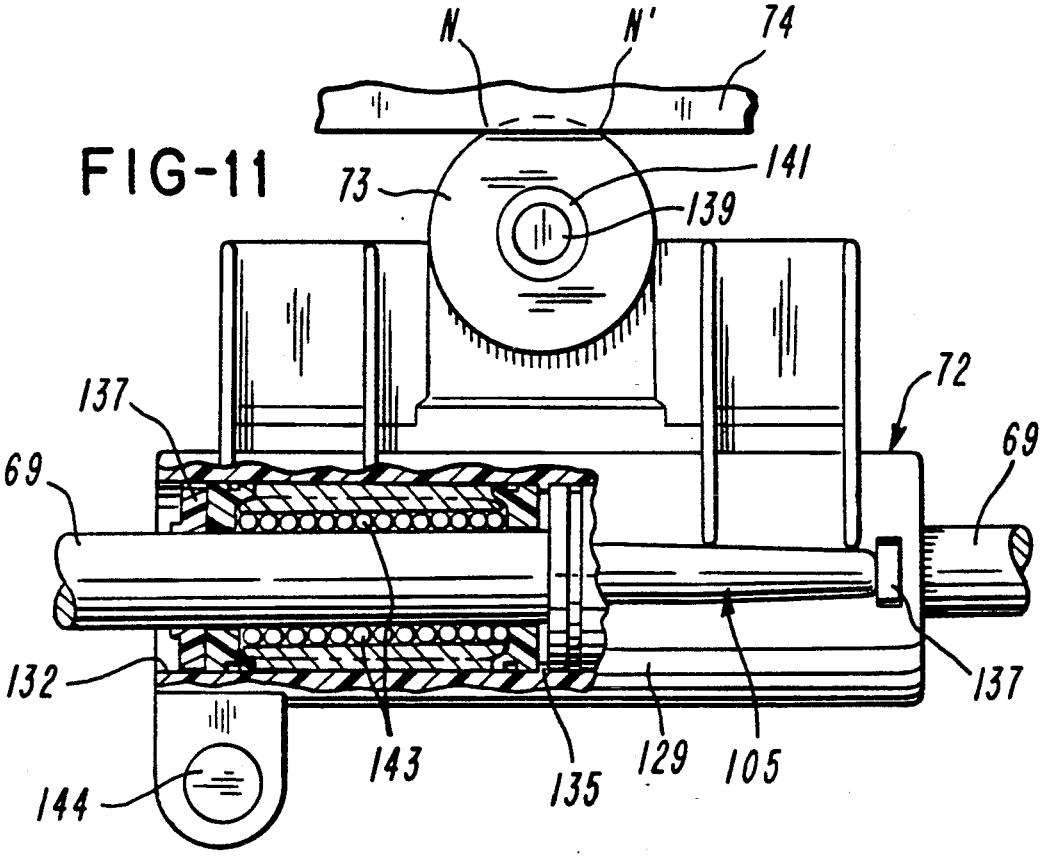
FIG. 11 is an elevational view of the slide on the rod showing the recirculating ball-type mechanism.

A mounting member generally indicated at 57 includes bar 58 joined to a pair of spaced arms 59 and 60. The arms 59 and 60 have respective holes 61 and 62 which receive respective bushings 63 and 64. The end members 39 and 40 have holes 65 and 66 which receive respective bushings 67 and 68. A rod 69 passes through the bushings 63, 64, 67 and 68 and is retained in position by E-rings 70 and 71. The rod 69 slidably mounts a slide or carriage generally indicated at 72. A pair of rotatably mounted rollers 72' on the slide 72 roll against the rod 54. The slide 72 mounts a rotatable generally annular knife 73. An elongate knife 74 cooperates with the rotatable knife 73 at a chord of the rotatable knife 73 as best shown in FIGS. 6 and 11. As shown, the side of the rotatable knife 73 bears against the side of the elongate knife 74. Tension springs 75 and 76 are connected at their one ends to projections 76 and 77 and at their other ends to end portions 78 of the rod 54. In this way the rotatable knife 73 and the elongate knife 74 are urged into cooperating cutting relationship. A pair of adjustable eccentrics 79 (FIGS. 2 and 7) define the stop portion of the mounting member 57 with respect to the mounting member 56 and prevent excessive separation of the elongate knife 74 from the rotatable knife 73 upon return of mounting members 36 and 57 and the associated components which they mount.

The bar 58 also mounts a pair of web guides 80 and 81 as best shown in FIG. 6. The guide 80 has a tapered opening 82 which guides the web W to a position immediately below the knife 74 and the guide 81 has a tapered opening 83 which guides the cut record member RM (FIG. 5) away from the cooperating knives 73 and 74.

Figure 12:
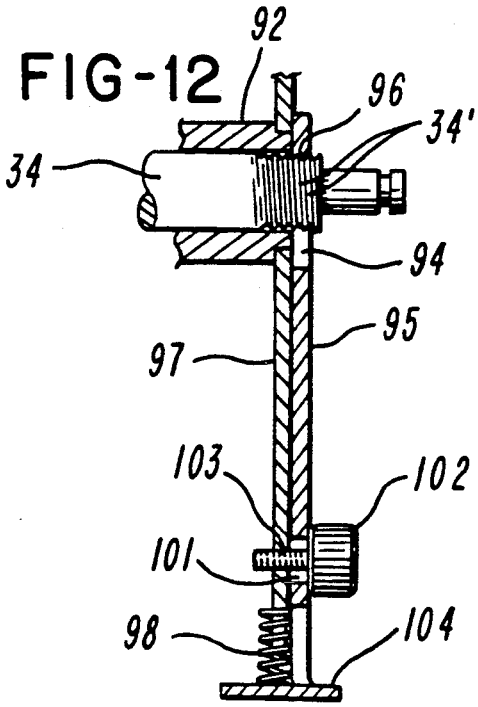
FIG. 12 is a sectional view of a quick release device for an adjusting mechanism.

The planar portion 22 mounts a bracket 84 which in turn rotatably mounts a cam roller 85 on a pin 86. A bracket 87 rotatably mounts a cam roller 88 on a pin 89. The bracket 87 has a pair of spaced holes 90 for receiving a reduced portion 91 of a tubular member 92. The E-ring 33 is received in a groove 93 in the reduced portion 91 so the bracket 87 is retained captive between the tubular member 92 and the E-ring 33. The threaded portion 34 extends through a hole 94 of a slidably mounted plate 95. The hole 94 is larger in internal diameter than the outer diameter of the threaded portion 34, except that the upper portion of the hole 94 is provided with internal threads 96 as best shown in FIG. 12. The threads 96 match threads 34' on the threaded portion 34. The plate 95 is in face-to-face contact with a plate 97 secured to the tubular portion 92. A compression spring 98 which receives a projection 99 on the plate 97 acts against a bent projection or tab 100 on the plate 95 to urge the plate 95 downwardly. The threads 96 are thus normally threadably engaged with the threads 34' on the threaded portion 34. The plate 95 has an elongate slot 101 for receiving the shank of a screw 102 which is threadably received in a hole 103 in the plate 97. The screw 102 can be tightened to hold the threads 96 locked to the threads on the threaded portion 34. To move the roller 88 for adjustment in an axial direction with respect to the rod 29, the screw 102 is loosened and a finger-engageable tab 104 is lifted to shift the plate 95 upwardly, thereby disengaging the threads 96 from the threads 34' of the threaded portion 34. The plates 95 and 97, the tubular portion 92, the bracket 87 and the roller 88 can now be shifted axially as a unit to reposition the roller 88 into a different selected position. If desired, screw 102 can be tightened to hold the plate 95 in the raised position with the threads 34' and 96 out of contact.

Figures 3, 4, 5:
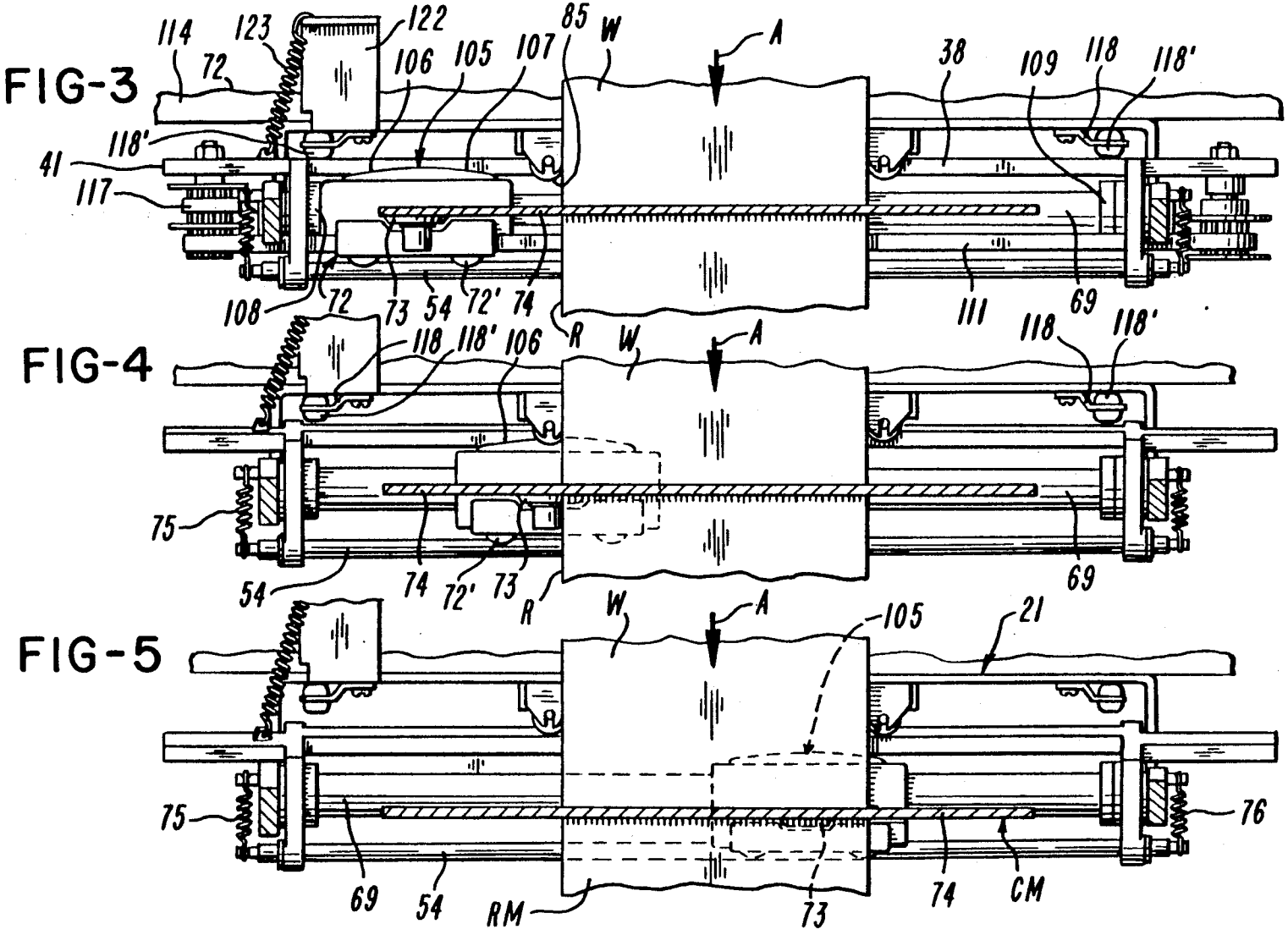
FIG. 3 is a horizontal sectional view of the apparatus and the advancing web.
FIG. 4 is a view like FIG. 3 with certain parts omitted, but showing that cutting of the web has started.
FIG. 5 is a view like FIG. 4, but showing that cutting of the web is nearly complete.

With reference to FIG. 3, there is shown a cam generally indicated at 105 molded integrally with the slide 72. The cam 105 includes a pair of smoothly joined rise or ramp portions 106 and 107. As shown in FIG. 3, the slide 72 is at the extreme left against a resilient bumper 108 on the rod 69 and the ramp portion 107 of the cam 105 is out of contact with the roller 85. However, the rotatable knife 73 is in cooperation with the elongate knife 74, although the nip N (FIG. 11) of the knives 73 and 74 is not in contact with the web W.

The slide 72 can be driven from its extreme left position shown in FIG. 3 to the extreme right position in which the slide 72 is against a resilient bumper 109 on the rod 69, and vice versa. A drive member or toothed belt generally indicated at 110 has an upper pass 111 and a lower pass 112. The teeth on the upper pass 111 engage teeth 131 on the slide 72 to lock the slide 72 to the upper pass 111. The belt 110 engages toothed wheels 46 and 49. A stationarily mounted reversible electric motor 113 (FIG. 1) is secured to the same stationary base 114 (FIG. 3) to which the planar portion 22 of the frame 21 is secured. The base 114 is part of a printer shown in U.S. Pat. No. 4,776,714 granted to Sugiura et al on Oct. 11, 1988 and assigned to Monarch Marking Systems, Inc. The motor 113 has a drive shaft 115 to which a toothed wheel 116 is secured. A toothed belt 117 engages the toothed wheels 47 and 116. Rotation of the drive shaft 115 in one direction causes the slide 72 to be driven in one direction and rotation of the drive shaft 115 in the opposite direction causes the slide 72 to be driven in the opposite direction.

Figure 7:
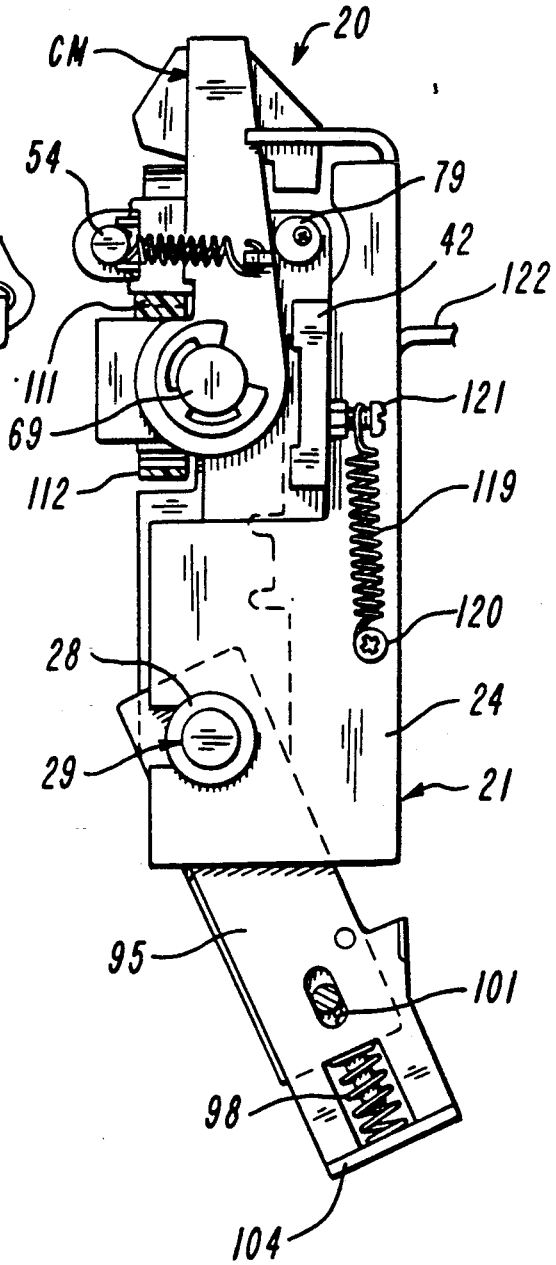
FIG. 7 is a vertical sectional view showing the right end portion of the cutting apparatus as viewed in FIG. 1.

As shown in FIG. 2, brackets 118 are suitably secured to the planar portion 22. Each bracket 118 mounts a pair of preferably resilient stops 118'. With reference to FIG. 7, there is shown a tension spring 119 secured to a screw 120 received by the wall portion 24 and to a screw 121 on the tab 42. A tab 122 is formed integrally with planar portion 22. A tension spring 123 is secured to the tab 122 and to the rear side of the tab 41. The springs 119 and 123 bias the cutting mechanism CM including the mounting member 37, the mounting member 57 and its elongate knife 74, the rods 54 and 69, the slide 72 and its rotatable knife 73, the belt 110 and associated toothed wheels 46, 47 and 49 as a unit counterclockwise about the rod 29 as viewed in FIG. 7. The springs 119 and 123 cause the bar 38 to contact the stops 118' in the initial or home position depicted in FIG. 3.

The cutting apparatus 20 is capable of cutting webs W of different widths. As shown in FIGS. 1 and 2, a switch 124 having a plurality of switch elements 125 is mounted to a tab 126 on the plate 97. As shown in FIG. 1, the position of the roller 88 can be adjusted lengthwise of the rod 29 by manually lifting up on the tab 104 to disengage the threads 96 from the threads 34' and thereafter shifting the plates 95 and 97, the tubular portion 92, the bracket 87, the roller 88 and the switch 124 as a unit either to the right or to the left. In the event the web W to be cut is narrower, then the roller 88 and the switch 124 are manually moved to the left in FIG. 1, and in the event the web W to be cut is wider, then the roller 88 and the switch 124 are manually moved to the right in FIG. 1. The position of the switch 124 thus determines the length of travel or movement of the slide 72. A switch 126 having a plurality of switch members 127 is secured to the bar 38. The switch 126 is always in the correct position with respect to an edge 128 of the guide 80 because the edge 128 is always the reference to side edge R of the traveling web W. However, the positions of the roller 88 and the switch 124 need to be adjusted in accordance with the width of the web W.

Figure 8:
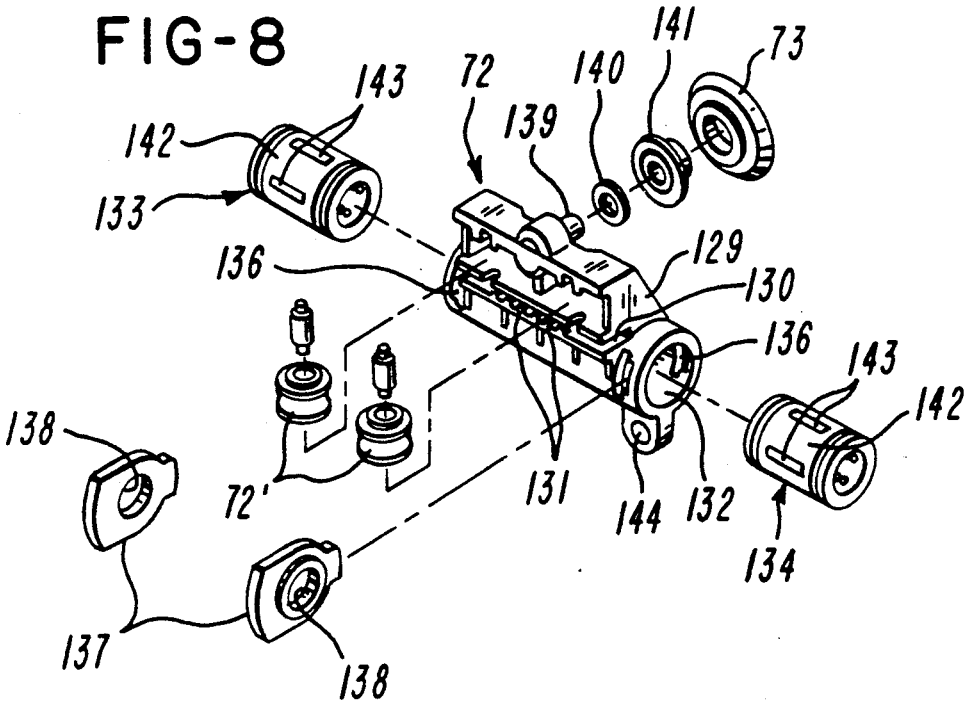
FIG. 8 is an exploded perspective view of a slide or carriage and the rotatable knife which it mounts.

With reference to FIG. 8, the slide 72 is shown to include body 129 preferably constructed of molded plastics material. The body 129 is shown to have a through-slot 130 for receiving the upper pass 111 of the belt 110. The teeth on the upper pass 111 engage teeth 131 on the body 129. The body 129 has a through-hole 132 for receiving spaced bearings 133 and 134. The bearings 133 and 134 can bear against an internal flange 135 (FIG. 11). The body 129 has pairs of aligned side openings 136 for receiving seals 137. The seals 137 are also retainers because they hold the respective bearings 133 and 134 in place. The seals have holes 138 for receiving the rod 69. The seals 137 provide only minimum clearance so as to keep paper dust and the like away from the bearings 133 and 134.

A metal post or shaft 139 is anchored firmly in the body 129. A washer 140 and a ball bearing 141 are received on the shaft 139 and the rotatable cutter 73 is mounted on the ball bearing 141.

Figure 9:
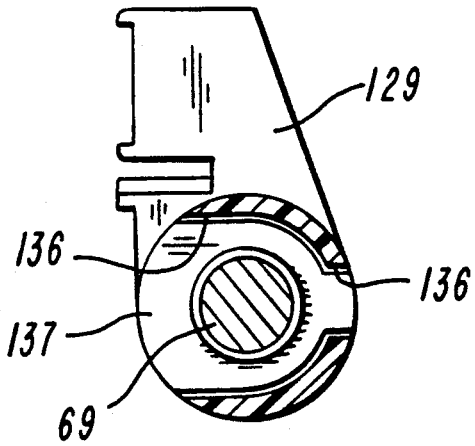
FIG. 9 is a sectional view of the slide, showing a seal on a mounting rod, with the slide being in one position relative to the seal.
Figure 10:
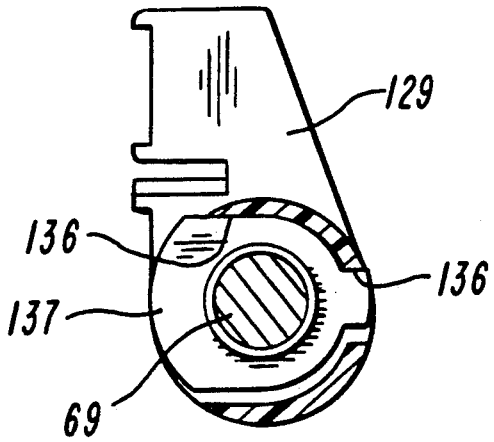
FIG. 10 is a sectional view similar to FIG. 9 but showing the slide in a different position with respect to the seal.

With reference to FIGS. 8 and 11, the bearings 133 and 134 are identical and each comprises a body 142 for receiving four equally peripherally spaced recirculating ball type mechanisms 143. The bearings 133 and 134 provide stability to the slide 72 and low frictional resistance. It will be appreciated that when the slide 72 travels linearly to the left (FIG. 11) and the nip N of the knives 73 and 74 engages the web W during cutting, the slide 72 is shifted clockwise very slightly as viewed in FIG. 11. Conversely, when the slide 72 travels in the opposite direction and the nip N' of the knives 73 and 74 engages the web W during cutting, the slide 72 is shifted counterclockwise very slightly as viewed in FIG. 11. Such shifting also occurs during acceleration prior to severing. This shift is caused because of inevitable play in the bearings 133 and 134. But the shifting resulting from the clearance or play does not affect the seal between the seals 137 and the shaft 69 because the seals 137 follow the shaft 69 and float with respect to the body 129 of the slide 72. As shown from a comparison of FIGS. 9 and 10, it is seen that irrespective of the position of the body 129 relative to the shaft 69, the seal 137 follows the shaft 69. Even though the seals 137 follow the shaft 69, the body 142 of each bearing 133 and 134 makes a relatively close sliding fit in the through-hole 132 so that paper dust and the like is prevented from migrating past the seals 137 and into the recirculating ball-type mechanisms. Each seal 137 is in contacting relation to the end face of the respective body 142. It is evident that each seal 137 wipes the dust from the shaft so it acts as a wiper. It is also evident that the seals 137 also retain the respective bearings 133 and 134 in place on the body 129.

With respect to a typical cutting cycle, the web W is moving on the direction of the arrow A as seen in FIG. 3 for example. The web W passes through guides 80 and 81 (FIG. 6). Although the knives 73 and 74 are in cutting relationship, the knives 73 and 74 are spaced to the left of reference edge R of the web W as shown in FIG. 3. When the electric motor 113 is energized, the belts 117 and 110 are driven and the slide 72 moves to the right from the position shown in FIG. 3. The slide 72 carries a magnet 144 (FIGS. 1 and 11) which cooperates with switch members 127 to help control the application of electrical energization pulses to the electric motor 113. As the slide movement of the cutting mechanism CM about the rod 29 in the direction of travel of the web W against the action of the tension springs 119 and 123. As is apparent, the cam 105 enables the inertia of the cutting mechanism CM to be overcome before cutting starts. When the slide 72 has moved far enough to the right, the web W is engaged by the nip N of the knives 73 and 74. This cutting engagement of the knives 73 and 74 with the advancing web W results in the cutting mechanism CM moving as a unit with the web W. As the slide 72 and its rotatable knife 73 continue to move to the right through the positions shown in FIGS. 4 and 5, the cutting mechanism CM continues to pivot about the rod 29. When the transverse or lateral cutting is complete, the magnet 144 cooperates with the switch members 125 to decelerate and stop the electric motor 113. When the knives 73 and 74 have completed severing the web W, the springs 119 and 123 return the cutting mechanism CM to its initial position, at which the bar 38 is in contact with stops 118'.

It is apparent that once the knives 73 and 74 start cutting, the cam 105 moves out of contact with the cam roller 85. The cam roller 88 does not contact the cam 105 as the slide moves to the right. On the next cutting stroke, the electric motor 113 drives the slide 72 in the opposite direction (to the left in FIGS. 3, 4 and 5) and the ramp portion 106 contacts the roller 88 to accelerate the cutting mechanism CM in the direction of movement of the web W (as shown by arrow A). The magnet 144 cooperates with the switch members 125 to control the acceleration of the motor 113. When the nip N' of the knives 73 and 74 engages the web W, the web W continues to move the cutting mechanism CM in the direction of web travel. When the cutting is complete, the magnet 144 cooperates with switch members 127 to decelerate and stop the electric motor 113.

It is evident that because the electric motor 113 is stationary and is not moved with the cutting mechanism as in prior art U.S. Pat. No. 4,693,151, there is no need to overcome the inertia of the electric motor 113 in moving the cutting mechanism CM. There is enough flexibility and stretch in the elastomeric belt 117 to enable the cutting mechanism CM to move freely even though the motor 113 is stationary. The belt 117 thus provides a flexible drive connection between the motor 113 and the drive member or belt 110.

The body 129 of the slide 72 as well as the body 142 of each of its bearings 133 and 134 are comprised of plastics material so as to keep the inertia of the slide 72 to a minimum. By way of example, not limitation, the bearings 133 and 134 are Super ball bearings sold under the designation SUPER-6 by Thomson Industries, Inc., Port Washington, N.Y. 11050.

Other embodiments and modifications of this invention will suggest themselves to those skilled in the art, and all such of these as come within the spirit of this invention are included within its scope as best defined by the appended claims.

We claim:

1. Apparatus for cutting record members from a longitudinally extending web, the apparatus comprising: a stationary frame, a cutting mechanism including a generally annular rotatable knife, an elongate knife cooperable with the rotatable knife at a chord of the rotatable knife, means for mounting the cutting mechanism on the frame for movement as a unit with a longitudinally traveling web, a slide for mounting the rotatable knife for movement relative to the elongate knife, means for moving the slide for travel in a direction generally parallel to the elongate knife to sever a generally rectangular record member from the web while the cutting mechanism and the web are traveling as a unit, wherein the traveling web moves the cutting mechanism longitudinally in the direction of web travel by engagement of the knives with the web, and means on the slide for accelerating movement of the cutting mechanism in the direction of web travel before the knives begin to sever the web.

2. Apparatus as defined in claim 1, wherein the slide moving means includes an electric motor mounted stationarily with respect to the frame.

3. Apparatus as defined in claim 1, wherein the cutting mechanism includes a rod, the slide being mounted for movement on the rod, spaced seals encircling the rod and floatingly mounted on and with respect to the slide, and a bearing disposed between the seals.

4. Apparatus as defined in claim 3, wherein the slide includes a side opening adjacent each seal, wherein one of said seals is received in each opening, and wherein the seals act as retainers to hold the respective bearings in place.

5. Apparatus as defined in claim 1, including means for adjusting the length of travel of the rotatable knife.

6. Apparatus for cutting record members from a longitudinally extending web, the apparatus comprising: a stationary frame, a cutting mechanism including a generally annular rotatable knife, an elongate knife cooperable with the rotatable knife at a chord of the rotatable knife, means for mounting the cutting mechanism on the frame for movement as a unit with a longitudinally traveling web, means for moving the rotatable knife for travel in a direction generally parallel to the elongate knife to sever a generally rectangular record member rom the web while the cutting mechanism and the web are traveling as a unit, wherein the traveling web moves the cutting mechanism longitudinally in the direction of web travel by engagement of the knives with the web, means for accelerating movement of the cutting mechanism in the direction of web travel before the knives begin to sever the web, wherein the cutting mechanism includes a pair of relatively movable mounting members, wherein the elongate knife is mounted on one of the mounting members and the rotatable knife is mounted on the other mounting member, and means for biasing one of the mounting members to urge the rotatable knife and the elongate knife into cooperating cutting relationship.

7. Apparatus as defined in claim 6, wherein the rotatable knife moving means includes an electric motor mounted stationarily with respect to the frame.

8. Apparatus for cutting record members from a longitudinally extending web, the apparatus comprising: a stationary frame, a cutting mechanism including a generally annular rotatable knife, an elongate knife cooperable with the rotatable knife at a chord of the rotatable knife, means for mounting the cutting mechanism on the frame for movement as a unit with a traveling web, means for moving the rotatable knife for travel in a direction generally parallel to the elongate knife to sever a generally rectangular record member from the web while the cutting mechanism and the web are traveling as a unit, wherein the traveling web moves the cutting mechanism in the direction of web travel by engagement of the knives with the web, wherein the cutting mechanism includes a pair of relatively movable mounting members, wherein the elongate knife is mounted on one of the mounting members and the rotatable knife is mounted on the other mounting member, and means for biasing one of the mounting members to urge the rotatable knife and the elongate knife into cooperating cutting relationship.

9. Apparatus as defined in claim 8, including means for pivotally mounting the biased mounting member.

10. Apparatus as defined in claim 8, including means for pivotally mounting the biased mounting member, and wherein the biasing means includes a spring acting on both mounting members.

11. Apparatus as defined in claim 8, wherein the rotatable knife moving means includes an electric motor mounted stationarily with respect to the frame.

12. Apparatus as defined in claim 8, wherein the cutting mechanism includes a rod, a slide mounted for movement on the rod, spaced seals encircling the rod and floatingly mounted on and with respect to the slide, and a bearing disposed between the seals.

13. Apparatus as defined in claim 12, wherein the slide includes a side opening adjacent each seal, wherein one of said seals is received in each opening, and wherein the seals act as retainers to hold the respective bearings in place.

14. Apparatus for cutting record members from a longitudinally extending web, the apparatus comprising: a stationary frame, a cutting mechanism including a generally annular rotatable knife, an elongate knife cooperable with the rotatable knife generally at a chord of the rotatable knife, means for mounting the cutting mechanism on the frame for movement as a unit with a traveling web, means for moving the rotatable knife for travel in a direction generally parallel to the elongate knife to cut a generally rectangular record member from the web while the cutting mechanism and the web are traveling longitudinally as a unit, wherein the traveling web moves the cutting mechanism in the direction of web travel by engagement of the knives with the web, wherein the cutting mechanism further includes a rod, a slide mounted for movement on the rod, spaced seals encircling the rod and floatingly mounted on and with respect to the slide, and a bearing disposed between the seals.

15. Apparatus as defined in claim 14, wherein the bearing includes a recirculating ball-type mechanism.

16. Apparatus as defined in claim 14, wherein the bearing includes a pair of spaced bearing members, each bearing member including a recirculating ball-type mechanism.

17. Apparatus as defined in claim 14, wherein the bearing includes a bearing member having a plurality of sets of recirculating ball-type mechanisms.

18. Apparatus as defined in claim 14, wherein the slide includes a side opening adjacent each seal, wherein one of said seals is received in each opening, and wherein the seals act as retainers to hold the respective bearings in place.

19. Apparatus for cutting record members from a longitudinally extending web, the apparatus comprising: a generally annular rotatable knife, an elongate knife cooperable with the rotatable knife at a chord of the rotatable knife, a rod extending generally parallel to the elongate knife, a slide for mounting the rotatable knife, the slide being received on the rod, spaced seals encircling the rod and floatingly mounted on and with respect to the slide, and a bearing disposed between the seals.

20. Apparatus as defined in claim 19, wherein the bearing includes a recirculating ball-type mechanism.

21. Apparatus for cutting record members from a longitudinally extending web, the apparatus comprising: a stationary frame, a cutting mechanism including a generally annular rotatable knife, an elongate knife cooperable with the rotatable knife at a chord of the rotatable knife, means for mounting the cutting mechanism on the frame for movement as a unit with a traveling web, means for moving the rotatable knife for travel in a direction generally parallel to the elongate knife to sever a generally rectangular record member from the web while the cutting mechanism and the web are traveling as a unit, wherein the traveling web moves the cutting mechanism in the direction of web travel by engagement of the knives with the web, wherein the cutting mechanism includes a pair of relatively movable mounting members, wherein the elongate knife is mounted on one of the mounting members and the rotatable knife is mounted on the other mounting member, means for biasing one of the mounting members to urge the rotatable knife and the elongate knife into cooperating cutting relationship, and means for pivotally mounting the biased mounting member on the other mounting member.

22. Apparatus for cutting record members from a longitudinally extending web, the apparatus comprising: a stationary frame, a cutting mechanism including a generally annular rotatable knife, an elongate knife cooperable with the rotatable knife at a chord of the rotatable knife, means for mounting the cutting mechanism on the frame for movement as a unit with a traveling web, means for moving the rotatable knife for travel in a direction generally parallel to the elongate knife to sever a generally rectangular record member from the web while the cutting mechanism and the web are traveling as a unit, wherein the traveling web moves the cutting mechanism in the direction of web travel by engagement of the knives with the web, wherein the cutting mechanism includes a pair of relatively movable mounting members, wherein the elongate knife is mounted on one of the mounting members and the rotatable knife is mounted on the other mounting member, means for biasing one of the mounting members to urge the rotatable knife and the elongate knife into cooperating cutting relationship, and means for adjusting the length of travel of the rotatable knife.

* * * * *